United States Patent [19]

Hensley

[11] 3,964,660

[45] June 22, 1976

[54] SNAP ATTACHING TOOL

[76] Inventor: Donald W. Hensley, 1822 Park Ave., Alton, Ill. 62002

[22] Filed: Mar. 13, 1975

[21] Appl. No.: 557,943

[52] U.S. Cl. ..... 227/15; 227/60; 227/147

[51] Int. Cl.[2] ..... A41H 37/04

[58] Field of Search ..... 227/147, 15, 60; 29/238, 243.53, 275, 243.52, 243.5; 81/3 R

[56] References Cited

UNITED STATES PATENTS

| | | | |
|---|---|---|---|
| 3,013,271 | 12/1961 | Carpinella | 227/15 |
| 3,209,451 | 10/1965 | Johns | 227/60 |
| 3,788,537 | 1/1974 | Fox | 227/147 |

*Primary Examiner*—Al Lawrence Smith
*Assistant Examiner*—Roscoe V. Parker
*Attorney, Agent, or Firm*—Grace J. Fishel

[57] ABSTRACT

A device for holding male and female mating snap members in alignment during a snap attaching operation has an elongated rigid barrel with a pin resiliently retractable into the leading end thereof. The pin is used as a centering means while the leading end of the barrel provides a driving device when the pin is retracted and the tool is struck at the opposite end of the barrel. The leading end of the barrel comprises a rim adapted to engage standard sized male and female mating snap members near their peripheries and the pin is adapted for maintenance of proper alignment of these members during attachment.

9 Claims, 6 Drawing Figures

SNAP ATTACHING TOOL

This invention relates to a device for attaching snap fasteners.

Various snap attaching tools have been provided in the past, generally in the form of pliers with specially adapted jaws. These devices have the common shortcoming that as the male or female member is attached, the driving force is applied unequally around the periphery of the snap member so that the snap is smashed on one side and barely attached on the opposite. Moreover, many of these devices require substantial gripping force, something that the feminine hand is frequently lacking. Other objects and features will be in part apparent and in part pointed out hereinafter.

The invention accordingly comprises the constructions hereinafter described, the scope of the invention being indicated in the following claims.

In the accompanying drawings in which one of various possible embodiments of the invention is illustrated, FIG. 1 is a perspective view of the snap attaching tool together with an exploded view of a male snap member;

Figure 1:
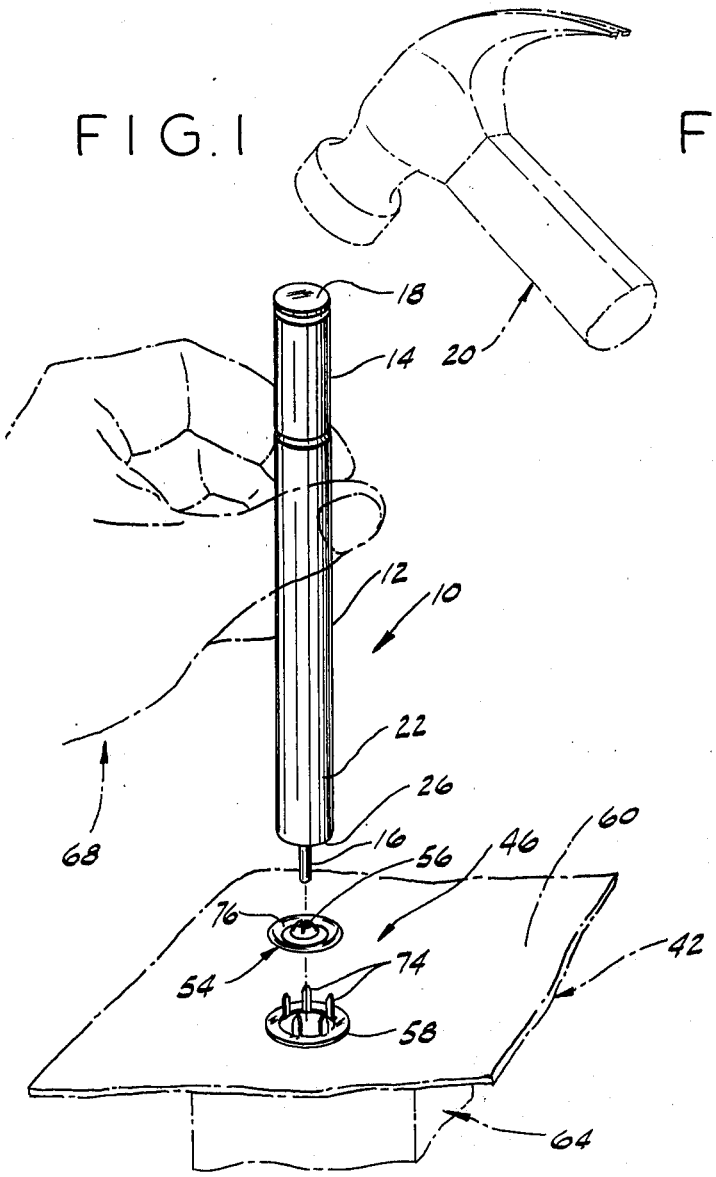

Referring to FIG. 1, a snap attaching tool 10 includes a barrel 12 with a cap 14 and a retractable pin 16. Cap 14 includes flattened head 18 which is adapted to be impacted by a driving tool such as hammer 20.

Barrel 12 comprises an elongated cylinder formed of a rigid material, such as steel, brass, high impact plastic or the like, and as shown includes ridges 22 to make the tool easier to grip and handle. Cap 14 and pin 16 are similarly formed of a suitable impact resistant material.

Barrel 12 has a centrally located bore 24 along its long axis. A leading end 26 of barrel 12 includes a recess 28 which communicates with bore 24 and which has a larger diameter than said bore adjacent thereto. Recess 28 may be chamfered as at 30 for use as described hereinafter.

Figure 2:
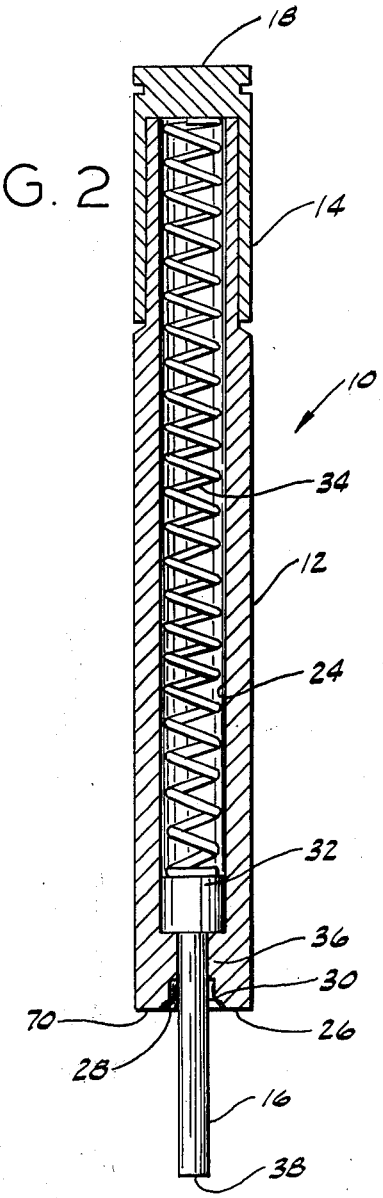
FIG. 2 is a side elevational view in section of the snap attaching tool.

As best seen in FIG. 2, pin 16 includes a flattened or enlarged head 32 which provides a pushing surface for coiled spring 34. Spring 34 is captivated in bore 24 and is under sufficient compressive force that it resiliently urges pin 16 out of bore 24 until stopped by land 36 adjacent recess 28. Spring 34 permits leading end 38 of pin 16 to be retracted inwardly to allow use of tool 10 as a device for holding male and female mating members in alignment during a snap attaching operation as described below.

In use, as best seen in FIG. 1, it is advisable to apply a test snap on a scrap of material 42 before working on a garment (not shown).

Figure 4:
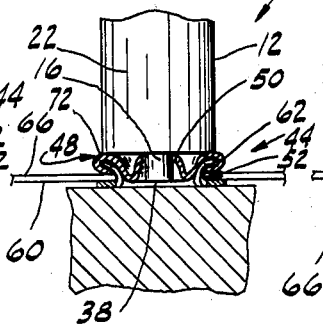
FIG. 4 is a fragmentary side elevational view of the snap attaching tool during attachment of a female snap member.
Figure 5:
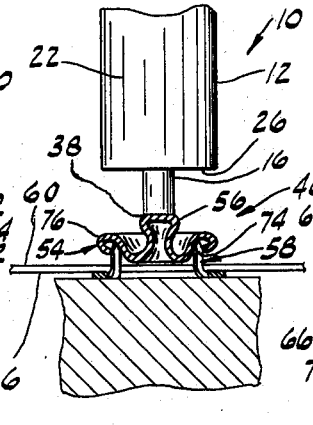
FIG. 5 is a fragmentary side elevational view of the snap attaching tool before attaching a male snap member.
Figure 6:
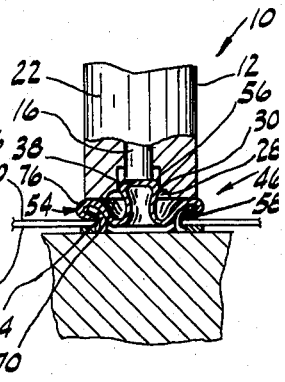
FIG. 6 is a fragmentary side elevational view partially broken away showing the snap attaching tool during attachment of a male snap member.

Each complete snap includes a female member 44 (shown in FIGS. 3–4) and a male mating member 46 (shown in FIGS. 1 and 5–6). Female member 44 includes a rimmed plate 48 with a socket 50 and a pronged ring 52. Male member 46 also includes a rimmed plate 54 with a ball or stud 56 and a pronged ring 58. As shown, pronged rings 52 and 58 are identical.

Figure 3:
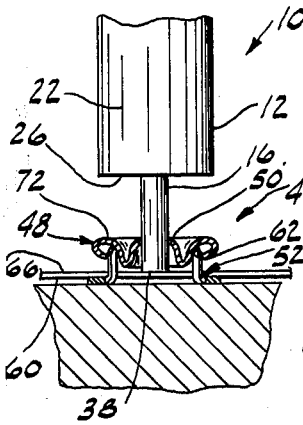
FIG. 3 is a fragmentary side elevational view of the snap attaching tool before attaching a female snap member.

To attach female member 44 to material 42, pronged ring 52 is pushed through material or fabric 42 on the outside 60 thereof at the selected place for attachment. Fabric 42 with prongs 62 pushed therethrough is laid on anvil 64, shown as a block of wood, with inside 66 of fabric 42 facing the user and with prongs 62 facing upwardly. Rimmed plate 48 is placed on prongs 62 as shown in FIG. 3 and gently pressed into partial seated engagement with socket 50 facing the user.

With rimmed plate 48 resting on prongs 62, female member 44 is ready to be attached by snap attaching tool 10. This is accomplished as best seen in FIGS. 3–4 by positioning tool 10 over socket 50 so that leading end 38 of pin 16 is slippingly received in socket 50. Tool 10 is pressed downwardly by hand 68 (FIG. 1) until pin 16 is retracted by compressing spring 34 and until rim 70 of leading end 26 rests against periphery 72 of rimmed plate 48. With rim 70 pressed against rimmed plate 48 and tool 10 held in alignment with female member 44 by means of pin 16 received in socket 50, a blow is struck to cap 14 by means of hammer 20 forcing rimmed plate 48 to be seated on prongs 62. It will be readily appreciated that barrel 12 should be generally perpendicular to the plane of rimmed plate 48 during attachment of female member 44. Otherwise, the driving force would be unequally applied around periphery 72 of rimmed plate 48.

To attach male member 46, pronged ring 58 is pushed through fabric 42 on the inside 66 thereof at the place desired. Fabric 42 is then laid on block 64 with outside 60 of fabric 42 facing the user and with prongs 74 facing upwardly. Rimmed plate 54 is placed on prongs 74 and finger pressed into place as best seen in FIG. 5. Snap attaching tool 10 is brought into substantially perpendicular alignment with the plane of rimmed plate 54 and leading end 38 of pin 16 is contacted with ball 56. As best seen in FIG. 6, barrel 12 is pressed downwardly, retracting pin 16 until rim 70 contacts periphery 76 of rimmed plate 54. A blow is then struck on cap 14 with hammer 20 to set male member 46 into permanent attachment.

Barrel 12 should be sized so that the inside diameter of recess 28 is sufficient to receive ball 56 therein. On the other hand, recess 28 must be small enough to slippingly contact ball 56 to maintain tool 10 in vertical alignment with male member 46 during attachment. To this end, recess 28 should be just large enough to slippingly accommodate ball 54. While the outside diameter of barrel 12 may exceed the diameter of rimmed plates 48 and 54, it is preferred that it not exceed the diameter of these conventional parts.

General good sewing practice dictates that snaps 44 and 46 be applied through three layers of light or medium weight material but only through two layers of heavy weight material, taking into consideration bulk. Customarily snap placement is marked on the inside of the garment with female members 44 on the right hand side of a closure and male members on the left for women's garments, the reverse for men's garments.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. A snap attaching tool comprising a barrel having a pin resiliently biased to extend from a first end and a second end adapted to receive a driving force, said pin adapted to be received in a socket of a female snap member and said barrel having a central bore with a recess at the first end for receiving the stud of the male snap member.

2. A snap attaching tool according to claim 1 wherein the pin is resiliently biased by means of a coiled spring, said spring being captivated in a bore centrally located along the long axis of the barrel.

3. A snap attaching tool according to claim 2 wherein the pin has a head forming a pushing surface for the coiled spring.

4. A snap attaching tool according to claim 3 wherein the barrel has an enlarged recess at the first end and a land communicating with the recess and with the central bore, said land comprising retaining means for holding the pin in the barrel.

5. A snap attaching tool according to claim 4 which further includes a cap on the second end of the barrel, said coiled spring pressing against the cap and the head of the pin.

6. A snap attaching tool according to claim 5 wherein the barrel and the cap are formed of impact resistant material.

7. A snap attaching tool according to claim 6 wherein the recess is chamfered adjacent the first end of the barrel to facilitate slipping receipt of the stud of the male snap member.

8. A snap attaching tool according to claim 7 wherein the outside diameter of the barrel is substantially the same as the outside diameter of the male and the female snap members.

9. A snap attaching tool according to claim 8 which further includes ridges along the outside of the barrel to facilitate holding the tool.

* * * * *